US010909816B2

(12) United States Patent
Hemberger et al.

(10) Patent No.: US 10,909,816 B2
(45) **Date of Patent: *Feb. 2, 2021**

(54) METHOD AND DEVICE FOR PRESENTING AND PLAYING CARD-TYPE GAMES

(71) Applicant: AGS LLC, Las Vegas, NV (US)

(72) Inventors: John Hemberger, Las Vegas, NV (US); Ofir Ventura, Las Vegas, NV (US); Zbigniew Czyzweski, Las Vegas, NV (US); Michael Skvorzov, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 2 days.

This patent is subject to a terminal disclaimer.

(21) Appl. No.: 16/525,247

(22) Filed: Jul. 29, 2019

(65) Prior Publication Data

US 2019/0355219 A1 Nov. 21, 2019

Related U.S. Application Data

(63) Continuation of application No. 15/270,079, filed on Sep. 20, 2016, now Pat. No. 10,373,444, which is a (Continued)

(51) Int. Cl.

| | |
|---|---|
| ***G07F 17/32*** | (2006.01) |
| ***A63F 1/00*** | (2006.01) |
| ***A63F 1/06*** | (2006.01) |

(52) U.S. Cl.

CPC ..... *G07F 17/3293* (2013.01); *A63F 1/00* (2013.01); *A63F 1/067* (2013.01); *G07F 17/322* (2013.01);

(Continued)

(58) Field of Classification Search

CPC ..... G07F 17/34

See application file for complete search history.

(56) References Cited

U.S. PATENT DOCUMENTS

| | | | |
|---|---|---|---|
| 4,836,553 A | 6/1989 | Suttle et al. | |
| 4,861,041 A | 8/1989 | Jones et al. | |

(Continued)

FOREIGN PATENT DOCUMENTS

| | | | | |
|---|---|---|---|---|
| AU | 2015203880 | * | 7/2015 | ..... A63F 1/00 |
| WO | 2000/016868 | | 3/2000 | |

OTHER PUBLICATIONS

International Search Report and Written Opinion for Application No. PCT/US2017/031560, dated Aug. 9, 2017, 20 pages.

(Continued)

*Primary Examiner* — Robert T Clarke, Jr.

(74) *Attorney, Agent, or Firm* — Weide & Miller, Ltd.

(57) ABSTRACT

In a method of presenting a game, a player places an ante wager, a secondary wager and one or more optional bonus or side bets via an input receiving device of a gaming table. Three cards are dealt to the player and a dealer, and thereafter two pairs of community cards are dealt. The player must place a tertiary wager to continue the game. The player and dealer attempt to form a highest ranking five card flush hand from their three cards and the community cards. The outcome of the player's ante, secondary and tertiary wagers are determined with reference to at least one of the dealer's hand and the player's hand. The optional bonus or side bets may be resolved relative to certain criteria for cards dealt in the game. Awards for winning wagers or bets may be awarded in accordance with a pay table or via a wheel spin or other award selection event which is initiated by the player.

17 Claims, 5 Drawing Sheets

Related U.S. Application Data continuation-in-part of application No. 15/149,410, filed on May 9, 2016, now Pat. No. 10,395,470.

(52) U.S. Cl.
CPC ..... *G07F 17/3206* (2013.01); *G07F 17/3209* (2013.01); *G07F 17/3244* (2013.01)

(56) References Cited

U.S. PATENT DOCUMENTS

| | | | |
|---|---|---|---|
| 5,393,067 | A | 2/1995 | Paulsen et al. |
| 5,472,194 | A | 12/1995 | Breeding et al. |
| 5,664,781 | A | 9/1997 | Feola |
| 5,707,285 | A | 1/1998 | Place et al. |
| 5,743,800 | A | 4/1998 | Huard et al. |
| 5,911,418 | A | 6/1999 | Adams |
| 5,984,779 | A | 11/1999 | Bridgeman et al. |
| 6,206,373 | B1 | 3/2001 | Garrod |
| 6,299,532 | B1 | 10/2001 | Smith |
| 6,299,534 | B1 | 10/2001 | Breeding et al. |
| 6,637,747 | B1 | 10/2003 | Garrod |
| 6,929,264 | B2 | 8/2005 | Huard et al. |
| 7,566,274 | B2 | 7/2009 | Johnson et al. |
| 7,651,394 | B2 | 1/2010 | Johnson |
| 7,931,532 | B2 | 4/2011 | Johnson |
| 8,096,556 | B2 | 1/2012 | Chamberlain et al. |
| 8,740,692 | B2 | 6/2014 | Yoseloff et al. |
| 8,961,298 | B2 | 2/2015 | Czyzewski et al. |
| 9,478,099 | B2 | 10/2016 | Czyzewski et al. |
| 9,536,379 | B2 | 1/2017 | Czyzewski et al. |
| 9,662,563 | B2 | 5/2017 | Van Asdale et al. |
| 9,811,980 | B1 | 11/2017 | Kowalchuk et al. |
| 2002/0195773 | A1 | 12/2002 | Dunn |
| 2003/0153377 | A1 | 8/2003 | Lisowski, Sr. |
| 2004/0061288 | A1 | 4/2004 | Snow |
| 2004/0090005 | A1 | 5/2004 | Snow |
| 2004/0183254 | A1 | 9/2004 | Schlumbrecht |
| 2005/0107148 | A1 | 5/2005 | Webb |
| 2007/0126186 | A1 | 6/2007 | Crawford, III et al. |
| 2010/0087241 | A1 | 4/2010 | Nguyen et al. |
| 2010/0113120 | A1 | 5/2010 | Snow |
| 2011/0034237 | A1 | 2/2011 | Schulhof et al. |
| 2011/0316233 | A1 | 12/2011 | Hong et al. |
| 2012/0083341 | A1 | 4/2012 | George et al. |
| 2012/0244924 | A1 | 9/2012 | Willis |
| 2013/0157752 | A1 | 6/2013 | Yoseloff |
| 2014/0200071 | A1 | 7/2014 | Czyzewski et al. |
| 2015/0018083 | A1 | 1/2015 | Czyzewski et al. |
| 2015/0199871 | A1 | 7/2015 | Czyzewski et al. |
| 2015/0379821 | A1 | 12/2015 | LaDuca |
| 2017/0039799 | A1 | 2/2017 | Czyzewski et al. |
| 2017/0203198 | A1 | 7/2017 | Lysowski et al. |

OTHER PUBLICATIONS

Shanghai Lanbao Sensing Technology Co., Ltd. "CR30S—Products," http://www.shlanbao.cn/en/product/show.aspx?id=1139, Copyright 2011, printed Oct. 21, 2016, 2 pages.

State of Washington Gambling Commission, "High Card Flush," http://www.wsgc.wa.gov/activities/game-rules/high-card-flush.pdf, May 28, 2013, 14 pages.

State of Washington Gambling Commission, "Ultimate Texas Hold 'Em Training Manual," http://www.wsgc.wa.gov/activities/game-rules/ultimate-texas-hold-em.pdf, Aug. 11, 2014, 23 pages.

STMicroelectronics, "VL6180X—Proximity sensor, gesture and ambient light sensing "ALS" module," http://www.st.com/en/imaging-and-photonics-solutions/v16180x.html, Copyright 2016, printed Oct. 21, 2016, 6 pages.

Wikipedia, "Euchre," https://en.wikipedia.org/wiki/Euchre, printed Oct. 19, 2016, 4 pages.

International Search Report and Written Opinion for PCT/US2017/012156, dated Mar. 13, 2017, 27 pages.

Omaha hold 'em—Wikipedia, the free encyclopedia, "https://len.wikipedia_org/w/index.php?title=Omaha_hold_%27em&oldid=722451289", May 28, 2016, 6 pages.

State of Washington Gambling Commission, "Mississippi Stud Training Manual," http://www.wsgc.wa.gov/activities/game-rules/mississippi-stud.pdf, Oct. 28, 2014, 17 pages.

State of Washington Gambling Commission, "Texas Hold 'Em Bonus Training Manual," http://www.wsgc.wa.gov/activities/game-rules/texas-hold-em-bonus.pdf, Oct. 28, 2014, 15 pages.

Texas hold 'em—Wikipedia, the free encyclopedia, "https:/ /en_wikipedia_org/w/index.php?title=Texas hold_ %27em&oldid=718982670", May 6, 2016, 18 pages.

International Search Report and Written Opinion for Application No. PCT/US2017/031511, dated Aug. 7, 2017, 19 pages.

* cited by examiner

METHOD AND DEVICE FOR PRESENTING AND PLAYING CARD-TYPE GAMES

RELATED APPLICATION DATA

This application is a continuation of U.S. patent application Ser. No. 15/270,079, filed Sep. 20, 2016, which is a continuation-in-part of U.S. patent application Ser. No. 15/149,410, filed May 9, 2016, which prior applications are incorporated by reference in their entirety herein.

FIELD OF THE INVENTION

The present invention relates to methods of presenting and playing games and gaming devices configured to present games.

BACKGROUND OF THE INVENTION

Table games are a very popular form of wagering games. These games are referred to as table games because they are presented at a gaming table rather than at a gaming machine. These games include, but are not limited to, blackjack, poker, baccarat and other types of card games, as well as roulette, craps and other types of games. Despite the many existing games, game players continue to seek new and different games and devices for presenting those games.

Two well-known games are the games of Texas Hold'em and Ultimate Texas Hold'em. Each game is a community card style poker game. Each player and the dealer are dealt two initial cards (the hole or pocket cards) which they combine with a total of five community cards (dealt as a set of 3 cards and then two individual cards) in order to form a best five card hand.

In the game of Texas Hold'em, the players play against one another for the pot. At the beginning of the game, the two players to the left of the dealer put out blind bets (a big blind and a small blind bet). After each player's two card are dealt, players to the left of the big blind bet have an option to call, raise or fold that bet. The community cards are then dealt, with rounds of betting permitted after each round of card dealing, thus providing three additional rounds of betting.

In the game of Ultimate Texas Hold'em, the players play against the dealer. Each player starts the game by placing a mandatory blind bet and an ante. After each round of card dealing, a further wagering option is provided relative to the placement of an additional wager, wherein a player must place an additional wager beyond their initial blind bet and ante after one of the rounds in order to not fold, and wherein the maximum amount of the additional wager decreases after each round of cards are dealt.

While these games offer multiple betting opportunities which increase the excitement of the game, the games are complex in that the outcome of each player's hand is dependent upon their ability to form the highest ranking hand (from their two cards combined with the community cards) from the many standard poker hands. In other words, a player must be very proficient in understanding the poker hands and their rankings and the potential odds of the dealer being able to form a better hand using the community cards, in order to be successful in the game. The games also require four dealing sequences and only offer a player 2 pocket or hole cards from which they may select cards to differentiate their hand from those of the other players or the dealer.

Another known game is the game of High Card Flush. In accordance with this game, each player and the dealer are dealt seven cards. From their seven cards, the dealer and player form their highest flush hand—.e.g. the combination of five cards from those seven cards which have the most cards of the same suit. An advantage to this game is that it is less complex than games like Ultimate Texas Hold'em in that a player's task is simply to pick the grouping of cards which have the most of the same suit. The player does not need to attempt to analyze the myriad of potential other poker hands which might be formed from the cards. On the other hand, this game is not very exciting because it has limited wagering opportunities. For example, in this game, a player places an ante wager to play the game and then either folds or places a raise wager after they are dealt their seven cards. Also, because the player and dealer are dealt separate seven card hands, it is difficult for the player to assess the probability of the dealer having a hand which may outrank the player's hand, removing much of the strategy from the game.

It will thus be appreciated that while players continue to seek new games, the development of a successful game depends on a myriad of intertwined criteria. For example, players desire games which are sufficiently challenging to retain their interest, but yet not too challenging to play or difficult to learn. Players also desire wagering games where the wagers are structured in a way in which they increase the tension and excitement of the game, but yet without the wagers being difficult to understand. In addition, the game must be configured so that it not only offers a reasonable rate of return/chance to win to the player, but in the case of games played again the house, offers the house a reasonable rate of return on the game. If the rate of return on a game to the house is too low, casinos will not offer the game and yet if the rate of return to the player is too low, the player will not play the game. With these and other objectives in mind, the present invention has been developed.

SUMMARY OF THE INVENTION

Embodiments of the invention comprise methods of implementing and presenting games, gaming tables, gaming systems and other gaming devices.

One embodiment of the invention comprises a method of presenting a card game to at least one player with physical playing cards at a uniquely configured game table which includes one or more input receiving devices and at least one display device. In one embodiment, a player places an ante wager, a secondary wager and optionally, one or more bonus or side bets. Three cards are then dealt to the player and a dealer. A player's then elects whether to place a tertiary wager of a first amount. First and second community cards are then dealt. If the player did not already place a tertiary wager, the player elects whether to place a tertiary wager of a second amount. Third and fourth community cards are then dealt. If the player did not already place a tertiary wager, the player must place a tertiary wager of a third amount or fold. If the player does not fold, the outcome of the player's ante, secondary and tertiary wagers are determined based upon flush poker hand rankings applied with reference to at least one of a player's hand comprising five cards selected from the player's three cards and the four community cards and a dealer hand comprising the highest ranking flush hand formed from the dealer's three cards and the four community cards, and wherein the outcome of the one or more optional bonus or side bets are determined with reference to one or more of the cards dealt in the game.

In one embodiment, the tertiary wager of the first amount is larger than the tertiary wager of the second amount, and the tertiary wager of the second amount is larger than the tertiary wager of the third amount.

In one embodiment, the one or more optional bonus or side bets comprise a first optional Same Suit bonus bet that is winning if the player's hand comprises a predetermined winning flush hand and/or a second optional 3 Card Flush side bet that is winning if the first three cards dealt in the game comprise a 3 card flush. In one embodiment, the optional bonus or side bets are winning regardless of the outcome of the player's ante, secondary and/or tertiary wagers, such as regardless of whether the player's hand beats the dealer's hand.

In one embodiment, one or more of the player's wagers are received by the at least one input receiving device, such as by sensing the player's location of at least one wagering chip in the proximity of the at least one receiving device.

In one embodiment, awards for winning wagers may be paid according to one or more pay tables. In another embodiment, the award for a winning wager may be determined by an award selection event. In one embodiment, the award selection event may comprise a wheel spin event in which a wheel segment selection event is displayed via the display device at the gaming table, wherein the selected segment has an associated award value, and wherein the award selection event is initiated by receiving a player's input via the at least one input receiving device.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of implementing games and devices and systems for implementing or presenting games. In a preferred embodiment, the methods of game play and presentation are implemented relative to a gaming table.

Figure 1:
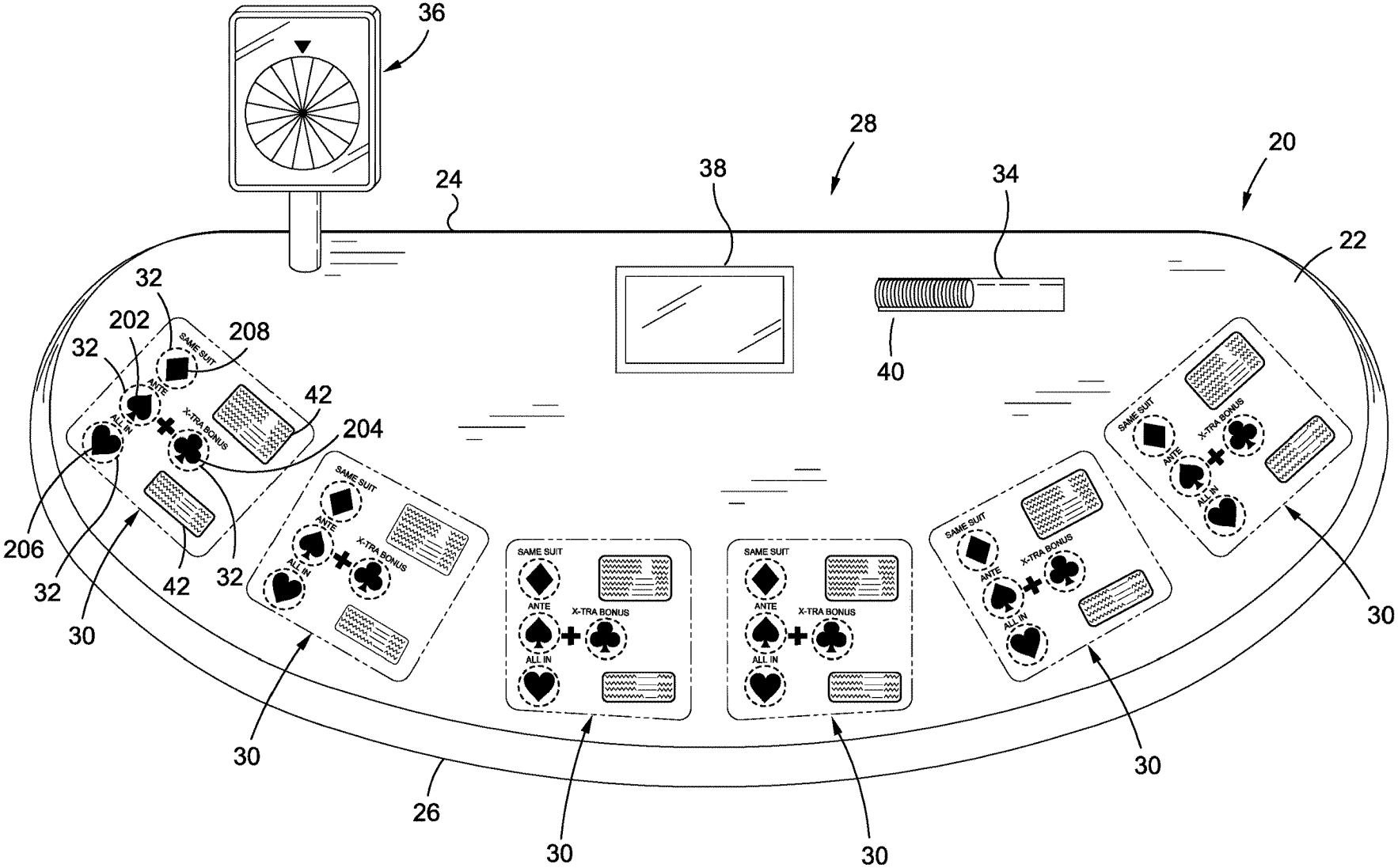
FIG. 1 illustrates a gaming table in accordance with one embodiment of the invention.

One embodiment of a gaming table in accordance with the invention will be described with reference to FIG. 1. As illustrated in FIG. 1, a game playing surface, such as a gaming table 20, is provided. The gaming table 20 defines a top or playing surface 22. The gaming table 20 may include one or more supports, such as a base, legs or the like (not shown) via which the playing surface 22 is elevated above a supporting surface such as a gaming floor.

The shape of the playing surface 22 may vary. In one embodiment, the gaming table 20 has a rear having a rear edge 24 which is generally straight and has an opposing front having a front edge 26 which is generally arcuate. A bumper or cushion may be located at either or both edges 24,26.

In one embodiment, the playing surface 22 is generally planar. However, the playing surface 22 could have one or more raised areas and/or one or more depressed areas or other features which are integrated into the table or added to the table, such as by being located on or mounted to the top surface thereof. Various game-related information or features are preferably associated with the gaming table 20. In one embodiment, the playing surface 22 comprises a gaming felt or similar element(s) which are located over a substrate, such as a planar support. The gaming felt may bear game play information or other information, such as by printing on the felt. This information may vary, such as depending upon the game or games which are to be implemented at the gaming table 20. For example, printing on the gaming felt may comprise one or more pay tables 42, card locations and the like.

In one embodiment, the configuration of the gaming table 20, such as via elements which are associated with the table 20 and information printed on the gaming felt, defines a dealer station 28 where a dealer may run a game, and one or more player positions 30. The dealer station 28 is generally located at the rear edge 24 and the player positions 30 are located opposite the dealer station 28 at the front or front edge 26. The dealer may, for example, stand at the rear of the table adjacent to the dealer station 28. A player may stand or sit adjacent to each player position 30 at the front of the gaming table 20.

In one embodiment, the game which is presented at the gaming table 20 comprises a wagering game. Wagers may be placed using physical gaming chips or other elements. In one embodiment, wagers by players may be sensed by detecting the association of one or gaming chips (or monies or other wagering implements) with one or more input receiving devices or input sensors 32. The input receiving devices or input sensors 32 might comprise buttons (wired or wireless), or other input device, but preferably comprise proximity sensors. The input receiving devices 32 may be located in or on the gaming table 20 and are configured to detect inputs, such as provided by players at the playing surface 22. In the case of proximity sensors, the sensors may be any type of proximity sensor now known or later developed, such as IR, acoustic, capacitive, or the like. In other embodiments, other types of sensors might be utilized, such as RFID or the like. For example, the input receiving devices 32 might comprise capacitive type sensors such as Lanbao CR30S series capacitive sensors (produced by Shanghai Lanbao Sensing Technology Co.; www.shlanbao.cn), which sensors behave as standard electrical 4-pin switches where the switch status changes when a chip (or other object, such as a player's hand) is placed on it. In another embodiment, the input receiving devices or sensors 32 might comprise a light sensing device which measures the distance between the sensor and a chip (or other object, such as a player's hand), such as the VL6180X ambient light sensing proximity sensor produced by STMICRO (www.st.com).

In one embodiment, one or more input receiving devices 32 are associated with each player position 30, thereby providing a means for each player to provide input relative to game play at the gaming table.

In one embodiment, the dealer station 28 may include one or more chip trays 34 which are located on or at the gaming table 20 for storing chips 40 which may be used to pay player winnings and/or in which chips which were used by players to place wagers may be collected.

In one embodiment, the gaming table 20 may include a number of other features. For example, the gaming table 20 may include one or more table displays 36. The table display 36 may comprise an electronic video display (such as an LCD, LED, OLED, DLP or other types of displays which are now known or later developed) or might even comprise a mechanical and/or electro-mechanical display device such as one or more spinning wheels or reels. The table display 36 may be located at or near the gaming table 20 for use in displaying game related information such as pay table information, game status information, game outcome information, bonus information or the like. The table display 36 might also be used to display promotional information or advertising.

The gaming table 20 might also comprise or include various input devices and/or other display devices. The input devices might include one or more dealer input devices such as one or more buttons or a dealer touchscreen display 38. For example, the dealer display 38 might comprise a display which displays game-related information to the dealer and allows the dealer to provide various inputs. Of course, various other types of input and display devices might be associated with the gaming table 20. The gaming table 20 might also include player touch-screens, inputs buttons or the like.

Additional details of a gaming table in accordance with one embodiment of the invention will be described with reference to FIG. 2. As illustrated, in this embodiment, elements of the gaming table 20 are associated with or connected to at least one table controller 100. The table controller 100 may be located at the gaming table 20 or may be remote therefrom.

In one embodiment, the table controller 100 comprises at least one processor 102 which is configured to execute machine readable code fixed in a tangible medium (e.g. "software"). The table controller 100 may also comprise one or more information or data storage devices 104. These data storage devices 104 may comprise any type of data storage device such as ROM, RAM, EPROM or the like, as well as mass storage devices such as hard drives. The data storage devices 104 may store various data, including game code or software which is executable by the processor(s) 102 and other data, such as game data including wager data, game outcome data, images, etc.

The table controller 100 preferably includes one or more communication interfaces 106. The communication interface(s) 106 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 102, data storage device(s) 104 and communication interface(s) 106 via one or more interfaces, such as a system bus 108. Of course, the table controller 100 might have other configurations, including other elements or features.

Figure 2:
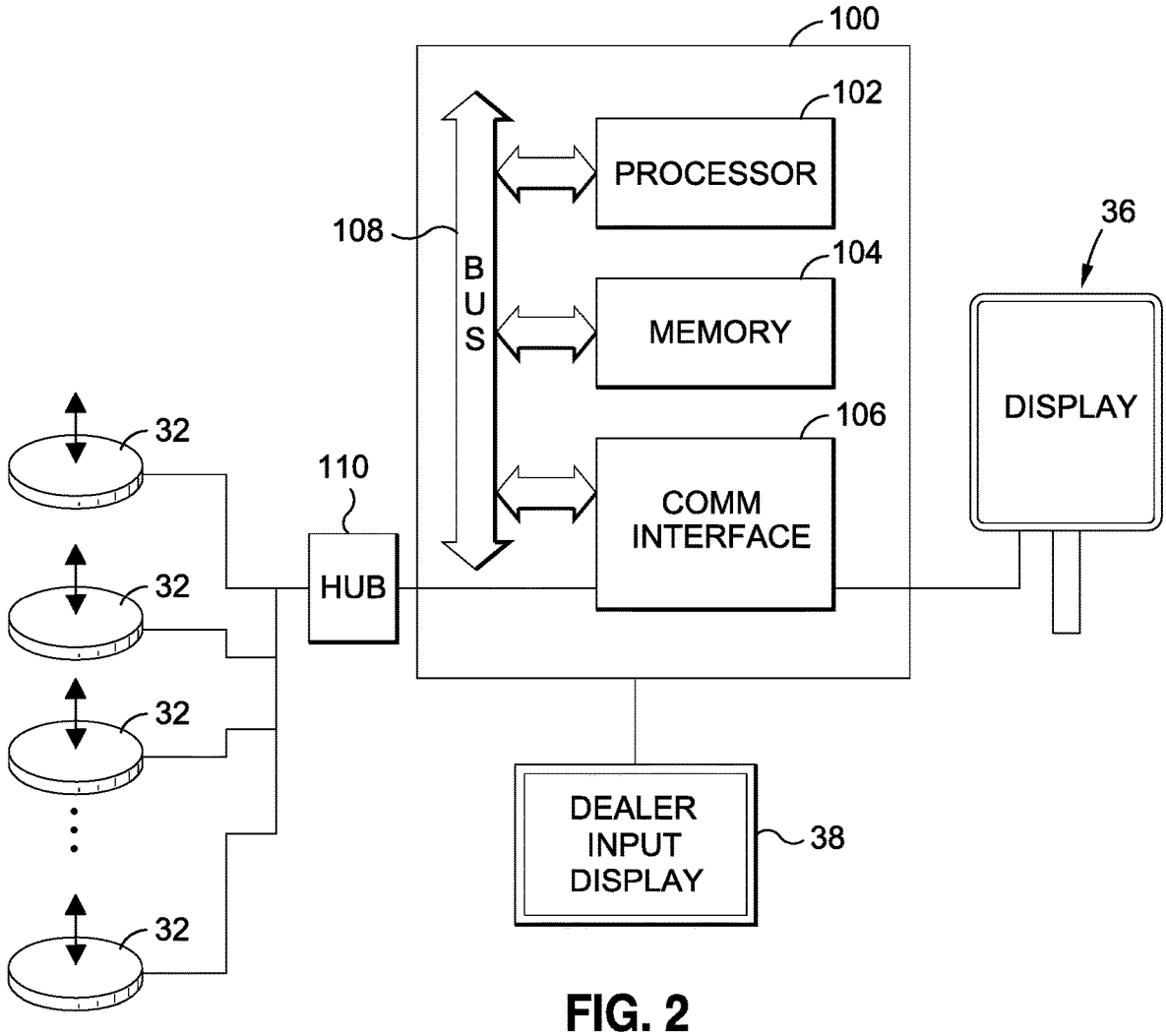
FIG. 2 illustrates a gaming system in accordance with one embodiment of the invention.

As illustrated in FIG. 2, the one or more input receiving devices 32 of the gaming table 20 may be interfaced with the table controller 100 to that the table controller 100 may receive information from those devices 32 and, in some embodiments, to transmit information to those devices. Likewise, the dealer input and/or display devices, such as the dealer touchscreen 38, may be interfaced to the table controller 100. Also, other input and/or display devices such as the table display 36 may be interfaced to the table controller 100.

In one embodiment, the table controller 100 or other devices associated with the gaming table 20 may determine player monetary or chip value balances, including based upon monies associated with the table by the player (such as chips purchased), amounts wagered and amounts won or the like.

The gaming table 20 of the invention may include or be associated with other elements or devices. For example, the gaming table 20 might include other gaming equipment, such as one or more player displays (such as located at each player position and configured to display game information, player tracking information, advertising or other information), card shoe(s), card reader(s), card shuffler(s), player tracking devices (such as for reading a player tracking card or other media of a player for use in tracking the player's game play) and the like. The gaming table 20 might also be connected to external devices. For example, the table controller 100 might be connected to one or more casino servers or systems, such as a casino accounting server which tracks game play at each gaming table 20, such as relative to the amounts of wagers placed and winnings paid to the players, among other information. The gaming table 20 might also be connected to a player tracking server and include player tracking elements such as player card readers.

The gaming system might include other elements, such as input receiving device controllers or the like. In one embodiment, the input receiving devices 32 communicate with a hub or aggregator 110 which communicates with the table controller 100. The hub 110 may be configured to read or determine the status of each input receiving device 32 and provide information to the table controller 100, such as when the status of an input receiving device 32 changes. The hub 110 may also comprise a power source for the input receiving devices 100. As another example, a proximity-type input sensor might be configured as a USB type device having a USB controller. The table controller 100 may be configured to control the proximity device as a USB device. In this regard, the processor 102 and/or one or more sub-processors or controllers may be utilized to control the input receiving devices.

In one embodiment of the invention, different input devices might be utilized for receiving different inputs (such as one input device for receiving a wager input and another input device for receiving a "spin" input or the like). In another embodiment, the one or more input receiving devices 32 are configured to receive multiple inputs. Each input receiving device 32 may be configured to receive two or more inputs. The inputs may be game-related inputs by a player and comprise two or more different types of inputs at two or more different times.

In one or more embodiments of the invention, aspects of the input receiving devices 32 and/or other devices or elements may be controlled or utilized to facilitate the receipt of the different player inputs. For example, the input receiving devices 32 and/or the table controller 100 may be configured to control the receipt of inputs, such as by selectively activating and deactivating the input receiving devices 32 so that they will receive input at certain times, but not others. In other embodiments of the invention described below, the configuration of the input receiving devices 32 may change to facilitate the input(s), such as by changing a detecting sensitivity to detect an intended player input from an unintended input. In yet other embodiments described herein, one or more secondary elements, such as audible and/or visual indicators may be used in conjunction with the input receiving devices 32 to facilitate the input receiving functionality of the input receiving devices 32.

In one example embodiment of the invention, such as disclosed in more detail below, a wagering game may be presented at the gaming table 20. The game may have a base game portion and a secondary or bonus game portion. For example, the base game portion may comprise a card game which is played with one or more decks of physical playing cards. The bonus game might comprise a bonus wheel spin for a potential bonus award. As detailed herein, however, other types or configurations of games which require player input may be implemented relative to the invention.

In one embodiment, the input receiving devices 32 may be turned off or be configured to not receive inputs except during designated times. This prevents, for example, inadvertent inputs from being received when games are not being presented or when other activities are occurring. For example, it may be preferable for the input receiving devices 32 to not receive inputs between games or during certain portions of a game.

In one embodiment, the input receiving devices 32 may be turned off by providing an instruction to them to not receive or transmit inputs. In other embodiments, the table controller 100 could be configured to ignore input signals from the input receiving devices 32.

In one embodiment, the input receiving devices 32 may be "activated", such as by turning them on or by causing the table controller 100 to be configured to receive inputs from the input receiving devices 32. This step may be implemented by a dealer, such as by input to the one or more dealer input devices. For example, the dealer display 38 might display a "start game/receive wagers" button which the dealer may select. In response to that input, the table controller 100 may be configured to receive inputs from the input receiving devices 32 or may send control instructions to those devices to cause them to be activated.

After activation, one or more first inputs may be provided to the one or more input receiving devices 32. This may comprise, for example, a first type of input such as a wager input, such as via the detection of one or more chips.

In one embodiment, each player who wishes to play the game may be required to place one or more wagers. The player might optionally be permitted to place other wagers. For example, a player might be required to place one or more base wagers to play the game and might be permitted to optionally place a bonus wager. In one embodiment, one or more input receiving devices 32 are associated with each player position 30. More than one input receiving device 32 may be provided relative to each player, such as for receiving a base wager and a bonus wager.

Figure 3A:
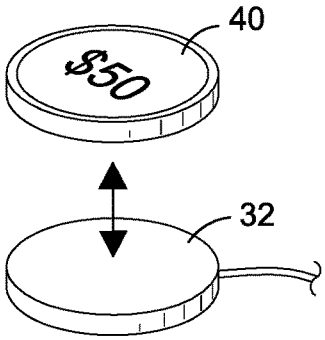
FIGS. 3A and 3B illustrate first and second inputs to an input receiving device in accordance with the present invention.

In one embodiment, a wager input may be provided by a player placing one or more chips 40 on or adjacent to a particular input receiving device 32, such as illustrated in FIG. 3A. At that time, the wager input(s) may be detected by those devices 32 and may be transmitted to the table controller 100 for processing. Wager information may be displayed to the dealer, such as via the dealer display 38. The dealer might then collect the wagers and place the wagered chips in the chip tray 34.

In one embodiment, after a first input period, the input receiving devices 32 may again be de-activated. Once again, this may comprise a dealer providing input to the dealer input device(s), such as the dealer touchscreen 38. For example, the dealer touchscreen 38 might display a "close wager" button which the dealer may select. This may cause the table controller 100 to no longer receive inputs from the input receiving devices 32 and/or to send a control instruction to those devices to de-activate them.

At one or more times, the input receiving devices 32 may be configured to receive one or more additional or second inputs. Such a secondary input might comprise a secondary or other additional wager. One or more of the secondary inputs may comprise a different type of input than the first input. In order to receive the at least one secondary input, the input receiving devices 32 may again be re-activated. In one embodiment, only certain input receiving devices 32 may be activated for receiving particular inputs. For example, a player who placed a bonus wager and received a certain bonus-triggering result from the play of a base game might be permitted to participate in a bonus event, such as a bonus wheel spin. As described below, in another embodiment, a player might be entitled to spin award wheel which selects or reveals one or more awards, such as an award for a winning bet. Of course, this spin technology could be implemented relative to a variety of games, including not only the game described below but other games such as base blackjack, baccarat and other games. Preferably, the input receiving devices 32 corresponding to only those players who are entitled to participate in the bonus event, award event or the like might be activated. The input receiving devices 32 relative to the other players preferably remain inactive, such as to prevent accidental input thereto.

Figure 3B:
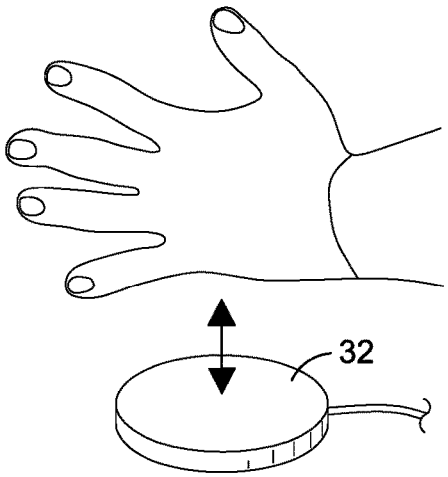

In one embodiment, an input might comprise a player placing their hand, one or more fingers or another body part or the like on or adjacent to the input receiving device 32, or waving their hand across the device, such as illustrated in FIG. 3B (for example, using the above-referenced VL6180X ambient light sensing sensor, the sensor detects the presence of the player's hand proximate to the sensor (by determining a distance of the player's hand from the sensor by determining a flight time of projected light which is reflected from the player's hand back to the sensor) in order to receive the player's hand input). In response, one or more game features or the like may be implemented by the table controller 100 and/or dealer in response to the received input. For example, in response to the detection of a player's hand, an input receiving device 32 may send a signal to the table controller 100. The table controller 100 may then be configured to cause the table display 36 to display the image of a wheel which rotates and then stops at a selected award or bonus location, such as illustrated in FIG. 1. The bonus spin outcome or award selection event may result in the player being awarded a bonus win or a selected award. Of course, this process might be repeated relative to each player who is entitled to a bonus spin or award selection event. In one embodiment, the input receiving device 32 corresponding to a first player is activated and receives an input from that player, the bonus element or other feature is implemented and then that input receiving device 32 may be inactivated. The input receiving device 32 relative to a second player may then be activated, and so on.

Figure 4:
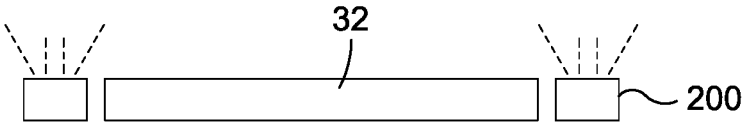
FIG. 4 illustrates an input receiving device having an associated indicator in accordance with one embodiment of the invention.

In one embodiment, the system might include one or more input receiving device indicators. These indicators might comprise, for example, audible and/or visual indicators. The indicators may provide an indication, such as by sound, light (including color), text or the like, of a status of an input receiving device 32 or an activity associated therewith. As one example, a visual indicator such as a color or multi-color light ring 200 might be located around an input receiving device, such as illustrated in FIG. 4. Of course, such an indicator might otherwise be located adjacent to an input receiving device 32 or even over such a device. The indicator lights might be located inside the device if the device is equipped with a translucent surface.

In one embodiment, the indicator(s) might provide an indication or information to a user comprising one or more of: (1) an inactive status of the input receiving device; (2) an active or ready for input status of the input receiving device; and (3) accepted or received input to the input receiving device. In one embodiment, the one or more indicator(s) are controlled in conjunction with the input receiving devices, such as via the table controller.

As one example, when an input receiving device is inactivate, an associated indicator (such as a light ring around the input receiving device) might be illuminated red. When it is active, and ready for a particular input, it might be illuminated flashing green. When an input is received, the flashing green light might transition to a steady green light.

Figure 5A:
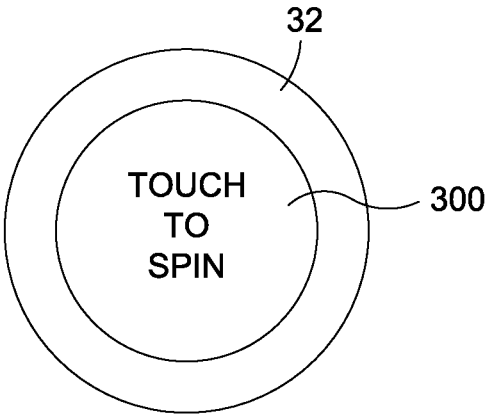
FIGS. 5A and 5B illustrate an input receiving device having an associated indicator in accordance with another embodiment of the invention.
Figure 5B:
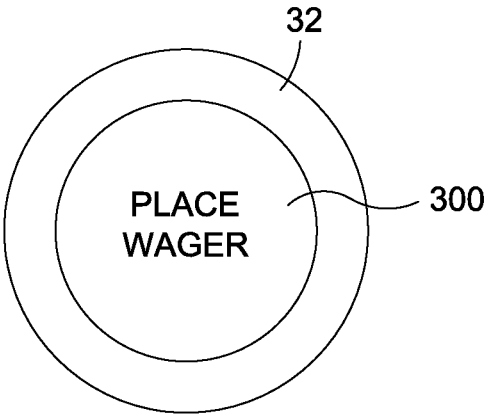

In another embodiment, text or other instructions might be displayed by the one or more associated indicators. For example, as illustrated in FIGS. 5A and 5B, a video screen 300 may be located over or may be located adjacent to an input receiving device 32. The video screen 300 might display "place wager" when the input receiving device is configured to receive a wager (as shown in FIG. 5B) and might display "touch to spin" or other instructions when the input receiving device is configured to receive a player spin input (as shown in FIG. 5A).

Of course, the indicator(s) may have various configurations. Preferably, the indicator(s) are located adjacent to or are associated with (and may even be integrated with) the input receiving device(s) 32.

As one example of the use of an input device where one or more indicators are utilized, an indicator associated with an input receiving device or sensor 32 may be activated to indicate to a player that their input receiving device 32 is ready to accept a wager. This might comprise, as indicated above, causing the indicator to illuminate a flashing green light, to cause a display to show a "place wager" instruction or the like. The input receiving device 32 may then receive an input in the form of one or more chips placed by the player.

The indicators may then be activated to indicate that the wager period is closed. This might comprise, for example, the indicators being illuminated red or displaying a "wagers closed" instruction or the like. Thereafter, such as after various steps of the game, an indicator may be activated to indicate that an associated input receiving device or sensor 32 is ready for a bonus spin input. This may comprise the indicator illuminating a flashing green light, showing a "touch to spin" instruction or the like. In a step SSA, a player's input to the associated input receiving device 32 may be detected.

In one embodiment, the indicator may be activated to indicate that the input was received from the player. For example, once the input receiving device 32 detected the player input and sent information regarding this input to the table controller 100, the table controller 100 may cause the indicator display a steady green light or to display an "input received" indication. Thereafter, the game feature might then be implemented based upon the player input.

Of course, at a gaming table where multiple players are playing, the indicators may indicate a particular status of an input receiving device corresponding to each player, where the status may vary from player to player. This allows the indicators to provide information to each player which is unique to that player. For example, during a bonus spin or award selection event phase, only the indicator associated with the input receiving device of a player whose turn it is to spin may indicate such (while the indicators associated with the input receiving devices of the other players may indicate that no input is to be provided by those players).

Of course, the indicators may be used in various manners. For example, the indicators might always be activated in a manner which confirms a player input, whether of a wager or a direct input, rather than just a player's direct input. In one embodiment, the status of the indicators may be automatically controlled by the table controller 100 or might be controlled by the dealer, or both. For example, a dealer might provide input which opens and closes a wagering period. When the dealer opens the wagering period, the indicators (via control from the table controller based upon the dealer's input) might indicate that the input receiving devices 32 are ready to receive wagers and when the dealer closes the wagering, the indicators may indicate that no more wagering inputs are being accepted (again as controlled from the table controller based upon the dealer's input).

As indicated herein, in one embodiment, input receiving device(s) 32 may move between active and inactive conditions. While the dealer may provide inputs to the table controller 100 to control input receiving device activation and de-activation, such might be at least partially automated. For example, in response to a dealer selecting a "start game" option, the table controller 100 might activate the input receiving devices 32 for purposes of receiving player wagers. The table controller 100 might automatically close wagering after a certain time, such as 1 minute, but automatically de-activating them.

In another embodiment of the invention, the input receiving device(s) 32 might always be active or might be inactive between games but always active during game play. In this embodiment, in order to reduce chance of inadvertent input to the input receiving devices(s), the indicators described above might be utilized. For example, instead of an input receiving device being truly inactivated, the associated indicator may indicate to a player that they should not provide an input to the device (although if the player did, such an inadvertent input might then still be registered).

In one embodiment, the input receiving device(s) 32 may be controlled to change one or more characteristics thereof, such as a sensitivity of the device. As one example, the table controller 100 or another controller might be used to implement a first input sensitivity of an input receiving device, such as relative to the detection of one or more chips, but another or second input sensitivity at another times. For example, an input sensitivity or similar characteristic might be controlled in order to reduce the chances for inadvertent input to the input receiving device 32, such a player's hand inadvertently passing over or near the device. This feature might be used, for example, to distinguish between a true "spin" input (or other input from the player) which is provided by a player's hand or the like, and an inadvertent passing of a portion of the player's hand or another object near the sensor which is not intended as an input. As another example, the input receiving device 32 might be configured to require an input of a length of time, such via detection of a player's hand adjacent to the input receiving device(s) for a period of time which would essentially avoid in inadvertent input from being logged. This type of input receiving device control, particularly relative to a proximity sensor, has particular applicability to the invention where the game may require multiple inputs from a player, including different types of inputs, during different times of the game.

Additional details of methods, devices and systems of the invention will now be described. Another aspect of the invention comprise a method of presenting and playing a game. In one embodiment, the game is played between one or more players and a dealer or the house. In one example embodiment of the invention, the method may be implemented relative to a gaming table. The gaming table might comprise the gaming table 20 described above, such as including the various input devices 32, table display 36 and other features, or it might comprise a gaming table which does not include some or all of such features, or might include other features.

Figure 6:
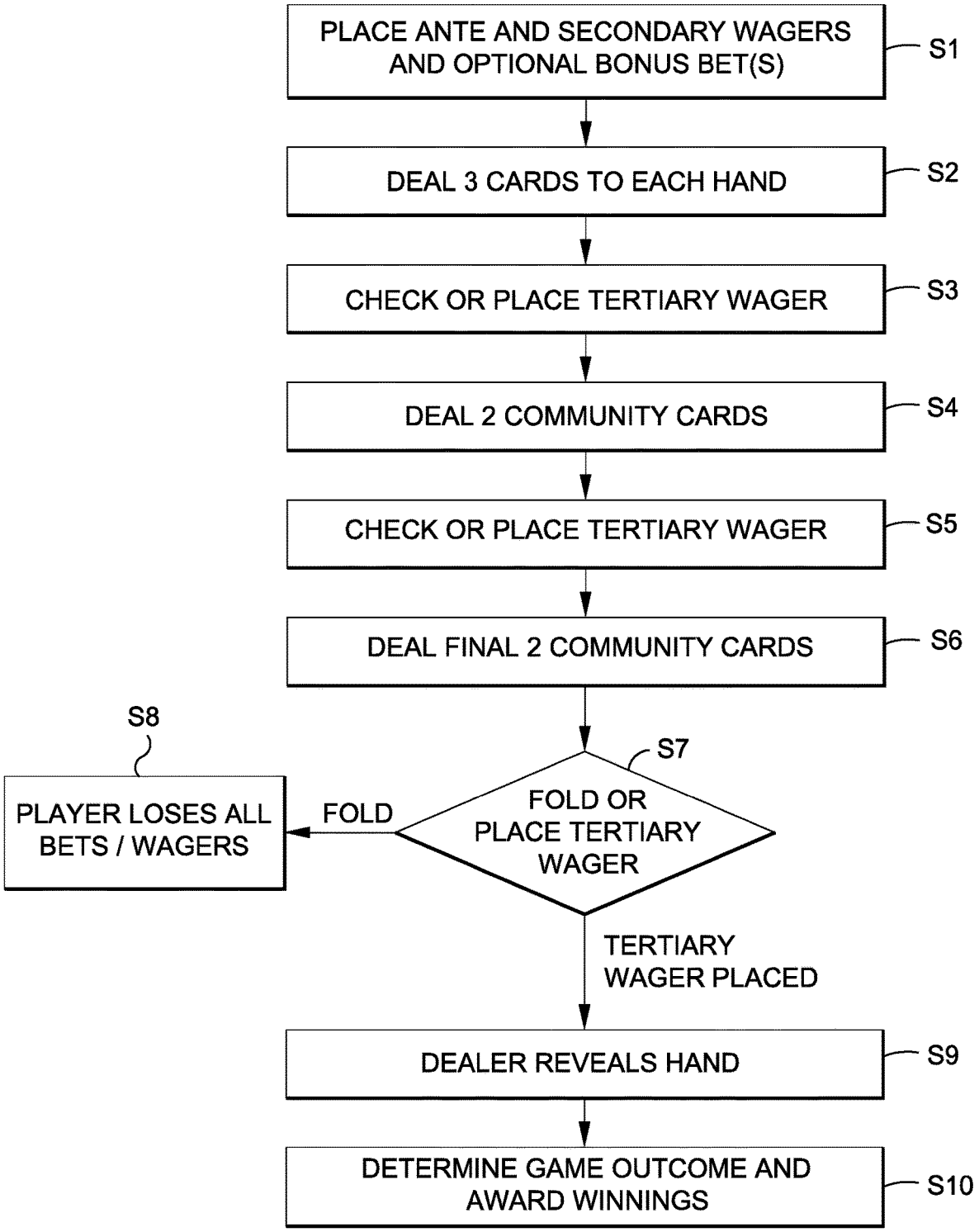
FIGS. 6 and 7 are flow diagrams which illustrate embodiments of presenting and playing games in accordance with the present invention.

Referring to FIG. 6, in a preferred embodiment, the game is played and presented as a wagering game. Thus, in a step S1, a player places one or more wagers. In one embodiment, a player is required to place an ante wager and a secondary wager (which is also referred to herein the "X-tra Bonus" wager). In one embodiment, an ante wager location 202 and a secondary wager location 204 are shown or displayed on the gaming table 20, as illustrated in FIG. 1. As indicated above, at least one input sensor 32 may be located at those wager locations for detecting a wager. In one embodiment, a player places one or more chips, coins or the like at the wager location(s), such as by locating the one or more chips or the like in proximity to the one or more sensors for detection thereby. The size of the ante and secondary wagers may have a minimum and/or maximum value, and in one embodiment, they are required to be of the same amount or size. In this embodiment, a single input sensor or receiving device may sense a player's location of a chip proximate thereto, thus registering the value of the chip as the wager amount for both the ante wager and the secondary wager.

In one embodiment, a player may optionally place one or more bonus or side bets. The bonus or side bets may comprise a first optional Same Suit bonus bet that is winning if the player's hand comprises a predetermined winning flush hand. As described below, the one or more bonus or side bets may instead comprise or also comprise a 3 Card Flush side bet that is winning if the first three cards dealt in the game comprise a 3 card flush. The player may place the bonus or side bet(s) at one or more bonus or side bet locations 208, which again may be associated with an input device 32. Again, the bonus or side bet may have a required minimum or maximum value. In a preferred embodiment, a player can only place a bonus or side bet if the player also places any required wager, such as the ante wager and secondary wager.

In a step S2, three cards are dealt to each player and the dealer. In a preferred embodiment, the dealer deals or causes the cards to be dealt, such as from one or more decks of physical playing cards. The one or more decks of cards preferably comprise 52 card decks where the cards have a front and a back, wherein the front or face thereof (but not the back) displays card rank and suit indicia comprising the suits Hearts, Diamonds, Spades and Clubs, with the ranks (from lowest to highest) 2-10, Jack, Queen, King and Ace.

In one embodiment, the one or more decks of cards may be shuffled by a shuffling device which is located at the gaming table and the dealer may deal cards which are provided by the shuffler. In another embodiment, the dealer might deal the cards from a card shoe located at the gaming table, such as from a card shoe device which stores one or more decks of cards and reads the cards as they are dispensed or dealt therefrom. The card shuffler and/or card shoe may be linked to the table controller, such as to provide information regarding read cards and the like.

In one embodiment, three cards are dealt to each participating player, e.g. a player who has placed the required ante and secondary (X-tra bonus) wagers, such as detected and registered by the input devices 32 and/or as confirmed by the dealer. In one embodiment, the cards are dealt to each player at their player position 30 and the dealer's cards are dealt to the dealer position 28. In one embodiment, the player's cards and the dealer's cards are dealt face down.

In a step S3, each player may check or place a tertiary or third wager of a first amount (which is also referred to herein as an "All-In" wager). If the player checks, the player does not place a wager. If the player places the tertiary wager, the player preferably places the wager at a tertiary (All-In) wager location 206 at the gaming table 20. Again, this input may be detected by an associated input device 32. In one embodiment, if the player elects to place a tertiary wager at this point in the game, the tertiary wager preferably comprises three times (3×) the player's ante wager.

In a step S4, two community cards (e.g. a first and second community card) are dealt. Again, the cards are preferably dealt by the dealer, preferably from the same deck or decks of physical playing cards. These two cards are preferably dealt face-up on the gaming table 20. The cards may be dealt to specific card locations displayed at the table.

In a step S5, players may check or again have the option of placing a tertiary wager or a second amount. In one embodiment, only players who have not already placed a tertiary wager may at this time place a tertiary wager. At this point in the game, the tertiary wager preferably comprises a wager of two times (2×) the player's ante wager. If a player places this tertiary wager, the player preferably places the wager at the tertiary (All-In) wager location 206 on the gaming table 20, which input may be detected by the associated input device 32.

In a step S6, two additional community cards (e.g. a third and a fourth community card) are dealt. Again, the cards are preferably dealt by the dealer, preferably from the same deck or decks of physical playing cards. These two cards are preferably dealt face-up on the gaming table 20. The cards may be dealt to specific card locations display at the table.

In a step S7, the players may fold check or may place a tertiary wager of a third amount. In one embodiment, only players who have not already placed a tertiary (All-In) wager may place a tertiary wager at this point in the game. Further, as indicated in step S8, if a player who has not yet placed a tertiary wager does not place one at this time, then the player automatically folds and loses their ante and secondary wager. In one embodiment, if the player places a tertiary wager at this point in the game, it must comprise a wager which is equal to (1×) the player's ante wager (in this embodiment, the tertiary wager of the first amount is greater than that of the second amount and the tertiary wager of the second amount is greater than that of the first amount, whereby the player can wager a higher tertiary wager earlier in the game as opposed to later in the game). Again, the player preferably places the wager at the tertiary (All-In) wager location 206 on the gaming table 20, which input may be detected by the associated input device 32.

In a step S9, the dealer reveals the dealer's cards (e.g. in the preferred embodiment, the initial three cards which were dealt to the dealer).

In a step S10, the outcome of the game is then determined. In one embodiment, the outcome of the ante wager, the secondary (X-tra bonus) wager and the tertiary (All-In) wager are determined relative to each player's hand and/or the dealer's hand wherein each player's hand comprises a five card hand formed from the three cards dealt to the player and the four community cards, and the dealer's hand comprises a five card hand formed from the three cards dealt to the dealer and the four community cards. In a preferred embodiment, the outcome of the game is determined with reference to flush poker hand rankings of the dealer hand and/or the player hands. Thus, the dealer preferably forms the highest ranking flush hand possible, as does each player. The outcome of the game preferably includes the collecting of losing wagers and bets and paying winnings for winning wagers and bets and/or returning wager or bets, such as in the event of a tie or "push." As described below, the outcome of the one or more bonus or side bets may be determined relative to various criteria, such with reference to the player's hand or other cards dealt in the game.

Figure 7:
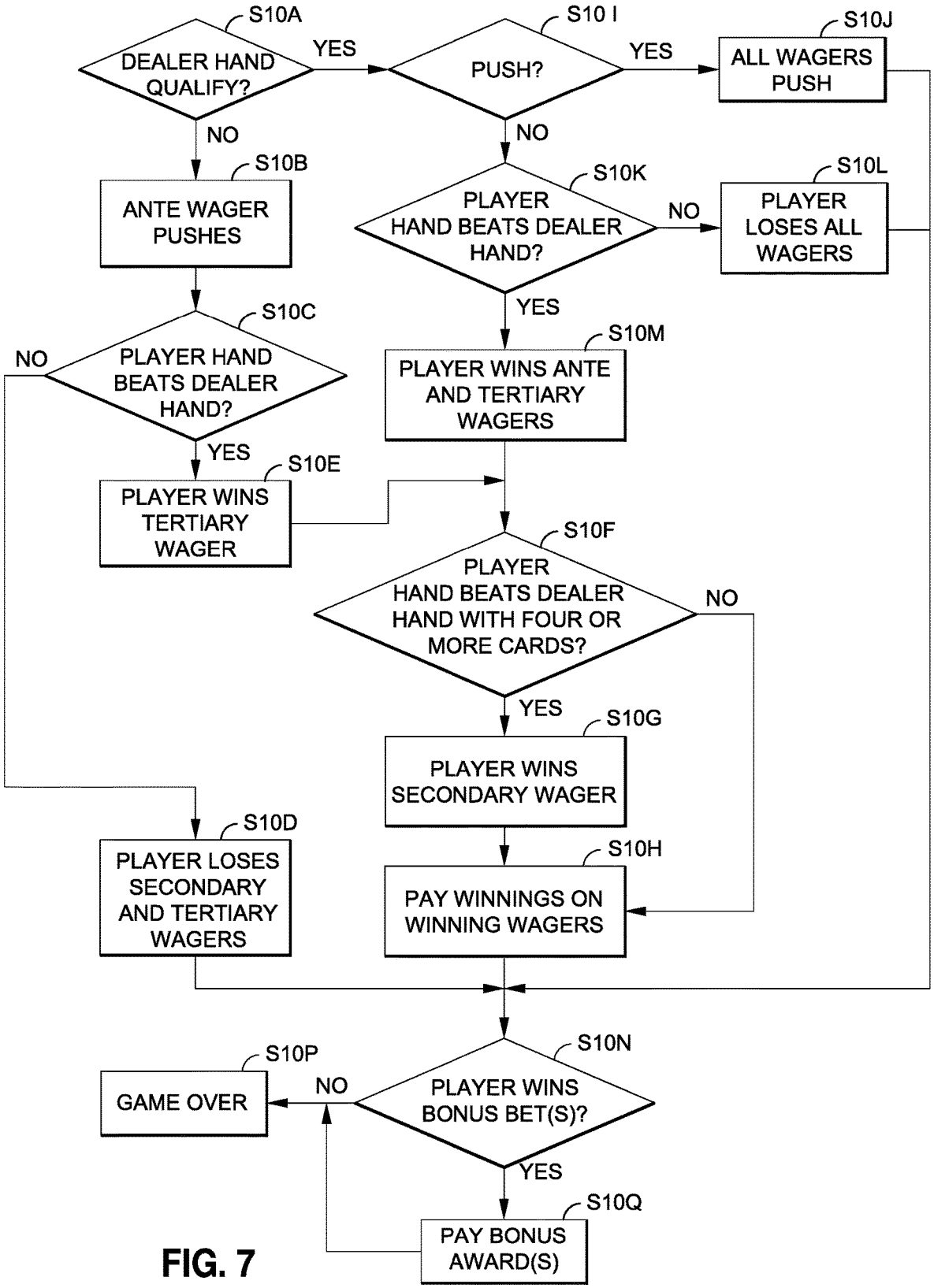

FIG. 7 illustrates one embodiment of a flow diagram which details a process for determining or resolving the outcome of the game. As illustrated in FIG. 7, in a step S10A, it is determined if the dealer's hand qualifies. In one embodiment, the dealer must have a hand comprising at least a three (3) card flush poker-type hand having a rank of at least nine (9) high (or greater). In other words, the dealer's hand must comprise at least three cards of the same suit (e.g. Hearts, Diamonds, Clubs or Spades) and at least one of those cards must have a rank of 9 or higher (e.g. 9, 10, Jack, Queen, King or Ace).

If the dealer's hand does not qualify, then in a step S10B, the outcome of the ante wager is a push (e.g. the player's ante wager is returned.) Then in a step S10C, it is determined whether the player's hand beat the dealer's hand. In one embodiment, the high or winning hand comprises the hand with the greatest number of cards of the same suit (e.g. the largest 'flush'). If the dealer's hand and the player's hand have the same number of cards of the same suit, then the hand with the highest card values (by rank), wins. For example, a player hand comprising A, 2, 4 of Diamonds would beat a dealer hand of K, 9, 9 of Hearts (because each hand has the same number of cards of the same suit but the player's hand has a high card Ace which outranks the dealer's high card King).

In a step S10D, if the player's hand does not outrank the dealer' hand (e.g. the dealer's hand is winning), then the player loses all of their remaining wagers (e.g. their secondary (X-tra Bonus) wager and their tertiary (All-In) wager). These wager amounts are collected by the dealer.

In a step S10E, if the player's hand does beat the dealer's hand, then the player wins their tertiary (All-In) wager (and the player may be paid or awarded winnings, as in step S10G described below).

In a step S10F, it is then determined whether the player won their secondary (X-tra Bonus wager). In one embodiment, the player only wins their secondary wager if the player's hand has at least four (4) cards to the same suit and beat the dealer's hand. If not, the outcome of the secondary wager is either a push (if the player's hand wins with less than a four card flush, then the secondary wager is preferably a push and the player's secondary wager is returned) or the player loses the secondary wager. If so, then the player wins the secondary wager, as in step S10G.

In step S10H, the player paid or awarded winnings for their winning wagers. In one embodiment, a winning tertiary wager is paid at even money (e.g. the player's tertiary (All-In) wager is returned and winnings are paid in the same amounts. In one embodiment, winnings are paid on the secondary (X-tra Bonus) wager based upon the following pay table (it being appreciated that other award values and winning hands could be defined):

TABLE A

| X-tra Bonus Wager flat pay table: | |
|---|---|
| X-tra Bonus | Pay to 1 |
| 7 Card Flush | 250 |
| 6 Card Flush | 20 |
| 5 Card Flush | 5 |
| 4 Card Flush | 1 |

In a step S10N, whether the player's hand was winning or losing, the outcome of the one or more bonus or side bets is determined. For example, if placed, the outcome of the player's Same Suit bonus bet is determined. If the Same Suit bonus bet is losing, no winnings are paid and the bet is collected and the game ends, as in step S10P. If so, then in step S10Q, winnings are paid. In one embodiment, a player only wins the Same Suit bonus bet if the player's hand has at least four cards of the same suit (regardless of whether the player's hand beat the dealer's hand or not). In one embodiment, winnings are paid on the Same Suit bonus bet based upon the following pay table (it being appreciated that other award values and winnings hands could be defined):

TABLE B

| Same Suit bonus bet pay table: | |
|---|---|
| Hand | Pay to 1 |
| 6-7 Card Straight Flush | 2000 |
| 7 Card Flush | 300 |
| 5 Card Straight Flush | 100 |
| 6 Card Flush | 50 |
| 4 Card Straight Flush | 20 |
| 5 Card Flush | 10 |
| 4 Card Flush | 1 |

It will be appreciated that in the instance where the player only wins the Same Suit bonus bet by having at least four (4) cards of the same suit, in this preferred embodiment of the game where the player's hand did not beat the dealer's non-qualifying hand of 3 cards of the same suit (as in step S10C), the player's hand could not meet the minimum criteria for winning the Same Suit bonus bet.

As detailed below, when the game also includes or instead includes a 3 Card Flush side bet, the outcome of this bet is also determined, as in step S10N.

Returning to step S10A, if the dealer's hand does qualify, then in a step S10I, it is determined if the dealer's hand and the player's hand push—e.g. have the same rank. If so, then in step S10J, all of the player's wagers, e.g. the ante wager, the secondary (X-tra Bonus) wager and the tertiary (All-In) wager, push. Thus, these wagers are simply returned to the player (with no award of winnings).

In a step S10K, it is determined whether the player's hand beats the dealer's qualifying hand. If not, then the player loses their ante, secondary (X-tra Bonus) and tertiary (All-In) wagers, as in step S10L.

If the player's hand did beat the dealer's qualifying hand as determined in step S10K, then the player wins their tertiary (All-In) wager, as in step S10M. Then it is determined whether the player also won their secondary (X-tra Bonus) wager, as in step S10F described above. The evaluation then proceeds as described above and the player is awarded winnings for any winning wagers.

Again, regardless of whether all of the player's wagers pushed as in step S10J, the player lost all of their wagers as in step S10L, or whether the player won either or both of their secondary (X-tra Bonus) and tertiary (All-In) wagers, the player's bonus or side bet(s), if placed, is preferably evaluated in step S10N as described above.

Of course, the above is applied to each participating player in the game.

It will be appreciated that the amount of winnings for particular winning outcomes might vary from those set forth herein. In one embodiment, the player may be paid winnings in the form of monetary value chips which are distributed to the player, such as by the dealer from the dealer's chip tray. Of course, the player might be paid winnings in other forms, such as by an increase in an electronic credit balance (which credit balance may preferably be cashed-out by the player by transfer of equivalent funds to a financial account such as a bank account, in the form of monies, etc.).

The game might include additional wagers or bets, such as additional bonus or side bets.

In one embodiment of the invention, winnings for one or more winning wagers or bets might be awarded in manners other than via pay table. For example, in the embodiment described above, a player is awarded winnings for their winning secondary (X-tra bonus) wager based upon one or more pay tables. In a preferred embodiment of the invention, the player is awarded winnings based upon an award selection event such as a spin of an award wheel.

Referring to FIG. 1, in one embodiment an award wheel may be displayed graphically on the display 36 at the gaming table 20. Each player who won their secondary (X-tra) bonus wager is given the opportunity to spin the wheel. As indicated above, in one embodiment, an input receiving device 32 may be activated. The player may then wave their hand or provide input to the input receiving device 32. The table controller 100 may then cause the display 36 to display a graphical representation of a spinning wheel which stops at a selected segment which corresponds to define the outcome of the wheel spin, and thus indicate the award which is awarded to the player.

In one embodiment, the input receiving devices 32 located at each participating player position may be activated in sequence. For example, six (6) players may be playing the game of the invention and only players in positions 1, 2 and 5 may have won their secondary (X-tra bonus) wager. In one embodiment, the dealer may indicate that it is time for those players to spin the award wheel to determine their awards. The input receiving device 32 corresponding to the player in position 1 might be activated first (such as by turning green, etc.) while the input receiving devices 32 at all other player locations may remain inactive. The player in position 1 may then provide input to their input device 32, thus initiating the wheel spin event. Thereafter, the input receiving device 32 corresponding to the player in position 1 is de-activated and the one corresponding to the player in position 2 is activated, and so on.

In one embodiment, the virtual wheel may be configured with segments which have associated awards and the probability of a particular segment being selected may be weighted. In the wheel spin event, a random number generator or the like may be used to generate a random number which is then compared to a lookup table of outcomes. The selected outcome corresponds to a segment having an assigned award. The controller may then cause the display 36 to display a wheel spin in which the wheel stops at the selected segment. In this configuration, certain outcomes or awards are more likely to occur than others. Set forth below in Table C is one configuration for a virtual award wheel for the X-tra Bonus Wager when the player has a four card flush or better (as an alternative embodiment to Table A), e.g. the player's hand comprises a 4, 5, 6 or 7 card flush which has a rank which beats the dealer's hand.

TABLE C

| X-tra Bonus Wager Bonus Spin: | | | |
|---|---|---|---|
| Number of Jackpots | Jackpot Amount | Community Amount | Wheel positions |
| 1 | $100,000.00 | | Jackpot |
| 5 | $10,000.00 | | 1 |
| 50 | $5,000.00 | $100.00 | 3 |
| 100 | $750.00 | | 8 |
| 1,800 | $500.00 | $50.00 | 6 |
| 4,500 | $100.00 | $15.00 | 9 |
| 2,544 | $75.00 | | 10 |
| 4,000 | $70.00 | | 11 |
| 7,000 | $65.00 | | 7 |
| 10,000 | $55.00 | | 4 |
| 19,900 | $50.00 | | 2 |

In this configuration, there are 50,000 potential outcomes and thus the odds of the jackpot amount being selected are 1:50,000 for a wheel spin. The odds of selecting a smaller award, such as $50.00, are much higher (19,900 out or 50,000). Notably, while the odds of receiving a smaller prize, such as the $50.00 prize, may be higher than that of certain larger prizes, the wheel may be configured to display fewer wheel segments having the lower prize amount (such as 2 segments which display the $50.00 award vs. 8 segments which display the $750.00 award), thus making the wheel appear to provide a higher chance of awarding a higher paying amount than comprise the true odds.

In this configuration, certain wheel spin outcomes also have an associated community amount or award, which amount may be paid to all or other players playing the game. In a preferred embodiment, the community award is paid to each player who placed a bet of a minimum amount.

As indicated above, the game may include additional or other bets or wagers. In a preferred embodiment, the game includes an optional "3 Card Flush" side bet. This bet may be optional, but the player may be required to place the bet at the beginning of the game before any cards are dealt, such as at the same time as the player has the opportunity to place the optional Same Suit bonus bet. In one embodiment, this side bet may be of a specific value, such as $5.00. Again, the player may place the bet, for example, associating a monetary value chip or the like with one of the input receiving devices 32, such as an input receiving device 32 at a 3 Card Flush bet location.

In one embodiment, the game includes determining if the first three cards dealt in the game comprise a 3 card flush—e.g. the side bet is winning if the first three cards dealt in the game are of the same suit. In one embodiment, the player wins the 3 Card Flush bet if this criteria is satisfied, regardless of whether or not they win any of their other wagers or bets (although the player is preferably required to place their ante wager and the like in order to participate in the game and thus have their 3 Card Flush bet be allowed).

In one embodiment, if the player wins their 3 Card Flush bet, then they are entitled to spin a bonus wheel which reveals the award for their winning bet. In one embodiment, the process for spinning the wheel may be similar to that described above. In one embodiment, the wheel is configured as follows:

TABLE D

| 3 Card Flush Bet Bonus Spin: | | | |
|---|---|---|---|
| Number of Jackpots | Jackpot Amount | Community Amount | Wheel positions |
| 1 | $10,000.00 starting | | Jackpot |
| 5 | $5,000.00 | | 1 |
| 20 | $2,500.00 | | 5 |
| 80 | $750.00 | $100.00 | 3 |
| 325 | $350.00 | | 7 |
| 500 | $500.00 | | 11 |
| 880 | $250.00 | $50.00 | 9 |
| 950 | $100.00 | | 8 |
| 2,800 | $40.00 | $15.00 | 6 |
| 5,500 | $70.00 | | 10 |
| 8,500 | $60.00 | | 4 |
| 25,439 | $50.00 | | 2 |

In this embodiment, certain of the outcomes may have community awards wherein awards are awarded to other players. In one embodiment, players who placed the 3 Card Flush bet are entitled to the community award if it is hit by another player. In a preferred embodiment, the jackpot is a progressive jackpot (which may start at $10,000 and increase until it is won; the rate of increase may be, for example, 7% of each placed 3 Card Flush bet).

Of course, the wheel spin event could be implemented by spinning a physical spinning wheel, such as where the stopping position of the wheel relative to a pointer or other selector is controlled, such as via a motor. The award selection event might also be represented by other than a wheel spin, but by other events.

It will be appreciated that the game might be presented with only the Same Suit bonus bet or with only the 3 Card Flush side bet, with both of them, and/or with other or additional bonus or side bets. Further, because the bonus or side bets are optional, a player might place none, one or both of the optional bonus or side bets (for example, even when both the Same Suit bonus bet and 3 Card Flush side bet are offered, a player might elect to not place either bet).

It will also be appreciated that the winning values and odds for the bonus or side bets might vary. In one embodiment, one or more bonus or side bet awards include a community award. However, no community awards might be offered or additional or other community awards might be offered.

Further, this configuration may be applied to other wagers or events. For example, instead of awarding winnings for a player's winning Same Suit bonus bet via a pay table, the player's award could be determined by a wheel spin event. Of course, the award configuration for such a wheel might be different than that for the secondary (X-tra bonus) wager or the 3 Card Flush side bet.

While the game may be presented at a gaming table by a live dealer using physical cards, the game may be presented at an automated gaming table. In this embodiment, the cards may automatically be dealt, such as by a card dealing device. It is also possible to present the game at a gaming table using virtual cards. For example, cards may be displayed on one or more video displays. As one example, community cards may be displayed graphically on a common video display and a player's cards may be displayed on a separate player display.

The game might also be presented at one or more electronic gaming devices or gaming machines, or via kiosks or the like which are tied or linked to a gaming table.

The game has numerous advantages. In one aspect of the game which offers a unique combination of features and elements which result in a game which his exciting to the player and viable for the house. Among other thing the game offers an exciting card dealing sequence in which a player receives 3 cards and then two rounds of community cards are dealt, each round having associated multiple wagering opportunities, thus increasing the anticipation and excitement associated with the game. For example, apart from an ante wager and a secondary wager, a player is required to make a tertiary wager, the value or size of which goes down as additional cards are dealt (thus limiting the player's potential win as the expectation of a win increases based upon the dealt community cards).

As another aspect of the game, a player may place and have the opportunity to win one or more optional bonus or side bets. In the preferred embodiment, the outcome of these bonus or side bets may be winning regardless of the outcome of the player's hand as compared to the dealer's hand. In one embodiment, the bonus or side bets may offer community award which result in the player being awarded winnings even when they did not win the bonus bet.

At the same time, the game is easy to understand and play, in that a player needs to only evaluate the potential of the dealer to form a flush hand and to themselves evaluate their cards and the community cards to form a flush hand—e.g. simply evaluate the sets of cards having the same suit. Another advantage to the game is that it utilizes community cards. This allows a player some opportunity to assess the probability that the dealer's hand will beat their hand because the player can see more than half of the card from which the dealer's hand can be formed. As another aspect of the invention, one or more exciting award selection events may be utilized to determine an award for a player's winning wager, thus also increasing the excitement of the game because the player does not know the award associated with their winning wager until that selection event is presented.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a game to at least one player at an electronic gaming device comprising a gaming table, the method comprising the steps of:

receiving an ante wager, a secondary wager and optionally at least one bonus or side bet from said player, at least one of said wagers or bets placed via at least one input sensor of said gaming table which is connected to a table controller;

dealing three physical playing cards to said player and a dealer from at least one deck of physical playing cards;

receiving an election from said player to check or receiving a tertiary wager of a first amount from said player;

dealing a first and a second community card from said at least one deck of physical playing cards;

when said player does not place said tertiary wager of said first amount, receiving an election from said player to check or receiving a tertiary wager of a second amount from said player;

dealing a third and a fourth community card from said at least one deck of physical playing cards;

when said player does not place said tertiary wager of said first or second amounts, receiving a tertiary wager of a third amount from said player; and determining an outcome of said player's ante wager, secondary wager and tertiary game with reference only to a flush hand ranking applied to at least one of a best five card flush dealer hand formed from said three cards dealt to said dealer and said first, second, third and fourth community cards, and a player hand formed from said three cards dealt to said player and said first, second, third and fourth community cards, and determining an outcome of said at least one bonus or side bet with reference to one or more of said dealt cards, wherein when the outcome of the secondary wager is a winning outcome, receiving a spin input from said player at said at least one input sense and initiating a wheel spin award selection event comprising a display of a selection of a segment of a multi-segment wheel at an electronic table display of the gaming table, and awarding an award associated with said selected segment.

2. The method in accordance with claim 1 wherein said first amount is greater than said second amount and said second amount is greater than said third amount.

3. The method in accordance with claim 1 wherein said at least one bonus or side bet comprises a Same Suit bonus bet and said step of determining an outcome of said at least one Same Suit bonus bet comprises declaring said Same Suit bonus bet to be winning if said player hand comprises at least four cards of the same suit and awarding an award for a winning optional Same Suit bonus bet.

4. The method in accordance with claim 1 wherein said step of determining an outcome of said player's ante wager, secondary wager and tertiary wager comprises determining if said dealer hand and said player hand push, wherein if said dealer hand and said player hand push, declaring a push as to said player's ante wager, secondary wager and tertiary wager.

5. The method in accordance with claim 1, wherein said step of determining an outcome of said player's ante wager, secondary wager and tertiary wager comprises determining if said dealer hand qualifies, wherein if said dealer hand qualifies, declaring said ante wager to push, and if said player hand loses to said dealer hand, declaring said secondary and tertiary wagers losing, and if said player hand beats said dealer hand, declaring said tertiary wager winning and declaring said secondary wager winning if said player hand beats said dealer hand with at least four cards to a flush.

6. The method in accordance with claim 1 wherein the table controller activates the at least one input sensor to control a time period during which the at least one input sensor can transmit the spin input from the player.

7. The method in accordance with claim 1 wherein said step of receiving an ante wager and a secondary wager from said player comprise sensing at least one wagering chip via said at least one input sensor and said spin input comprises detecting at least a portion of said player's hand adjacent to said at least one input sensor.

8. The method in accordance with claim 1 wherein said step of determining an outcome of said player's ante wager, secondary wager and tertiary wager comprises determining if said dealer hand qualifies, wherein if said dealer hand does not qualify and said player's hand does not beat said dealer hand, declaring all of said player's wagers losing, and wherein if said player's hand beats said dealer's hand, declaring said player's ante wager and tertiary wager winning and declaring said secondary wager winning if said player hand beats said dealer hand with at least four cards to a flush.

9. The method in accordance with claim 8 wherein said dealer hand qualifies if it comprises at least a three (3) card flush poker-type hand having a rank of at least a nine (9) high card.

10. The method in accordance with claim 1 wherein said at least one input sensor comprises a proximity sensor.

11. The method in accordance with claim 1 wherein said physical playing cards are dealt from a card shoe which reads said cards as they are dealt.

12. The method in accordance with claim 1 further comprising registering said player's wagers and said at least one optional bonus or side bet at a dealer station via the table controller.

13. The method in accordance with claim 1, wherein said at least one bonus or side bet comprises an optional 3 Card Flush side bet and wherein said step of determining an outcome of said at least one bonus or side bet comprises declaring said 3 Card Flush side bet winning if the first three cards dealt in said game comprise a 3 card flush hand.

14. The method in accordance with claim 13 further comprising the step of receiving a spin input from said player at said at least one input sensor an initiating a wheel spin award selection event comprising the display of the selection of a segment of a multi-segment wheel at an electronic table display of the gaming table, and awarding an award associated with said selected segment for said winning 3 Card Flush side bet.

15. The method in accordance with claim 14 comprising awarding an award to said player and awarding a community award to at least one other player who placed said 3 Card Flush side bet.

16. The method in accordance with claim 1 wherein said first amount comprises 3 times the amount of the ante wager, the second amount comprises 2 times the amount of the ante wager and the third amount is equal to the ante wager.

17. The method in accordance with claim 1 wherein when said player does not place said tertiary wager of said first, second or third amounts, collecting said player's ante and secondary wagers.

* * * * *